US005551352A

United States Patent [19]

Meier et al.

[11] Patent Number: 5,551,352

[45] Date of Patent: Sep. 3, 1996

[54] TABLE OR COVER PLATE

[75] Inventors: Max Meier; Karl-Heinz Meier, both of Lichtenau, Germany

[73] Assignee: Mecalit GmbH Kunststoffverarbeitung, Lichtenau, Germany

[21] Appl. No.: 390,043

[22] Filed: Feb. 17, 1995

[30] Foreign Application Priority Data

Feb. 25, 1994 [DE] Germany ..... 44 06 118.8

[51] Int. Cl.[6] ..... A47B 17/00

[52] U.S. Cl. ..... 108/27; 108/157

[58] Field of Search ..... 108/27, 157; 312/137, 312/140.1, 140.4; 49/462

[56] References Cited

U.S. PATENT DOCUMENTS

| | | | |
|---|---|---|---|
| 4,663,912 | 5/1987 | Vinther . | |
| 4,748,780 | 6/1988 | Vinther . | |
| 4,754,714 | 7/1988 | Drumm | 108/157 |
| 4,805,541 | 2/1989 | Drane et al. | 108/157 X |
| 4,823,709 | 4/1989 | Tesney | 108/157 |
| 4,934,541 | 6/1990 | Bussan et al. | 108/27 X |
| 5,062,665 | 11/1991 | Schotthoefer | 49/462 X |
| 5,173,348 | 12/1992 | Gevaert et al. | 312/137 X |
| 5,404,828 | 4/1995 | Tesney | 108/27 |
| 5,436,048 | 7/1995 | Meier et al. | 108/27 X |

FOREIGN PATENT DOCUMENTS

| | | | |
|---|---|---|---|
| 2732351 | 2/1979 | Germany | 108/27 |
| 2833863 | 2/1980 | Germany | 108/27 |
| 3329172 | 2/1985 | Germany | 108/27 |
| 1002175 | 8/1964 | United Kingdom | 108/27 |

*Primary Examiner*—Jose V. Chen

*Attorney, Agent, or Firm*—Antonelli, Terry, Stout & Kraus

[57] ABSTRACT

An assembly comprises a core plate and peripheral edge protection covering a cut surface of the core plate and contacting the top and underside thereof. The edge protection comprises two angle sections injection molded in frame form. An outer frame covers the surface of the cut surface with a longer leg and contacts the underside of the core plate and contacts the top with a shorter leg. An inner frame is connected by one leg thereof to the longer leg of the outer frame and contacts with a further leg thereof the underside of the core plate. Elastic seals are placed between the cut surface and the inner frame. An expansion gap for the core plate is also provided between the cut surface and the inner frame.

22 Claims, 5 Drawing Sheets

TABLE OR COVER PLATE

BACKGROUND OF THE INVENTION

1. Field of the Invention

The invention relates to a table cover plate or board.

2. Description of the Prior Art

In the case of plates or boards the edge protection has a number of functions. It is firstly intended to protect the edges against mechanical damage and secondly to protect the user from injury. If the core plate is made from a wood material, the open-pore cut edges of the core plate must also be protected against dirty and moisture. Finally the edge protection is intended to improve the gripability of the plate and therefore the handlability and transportability of an item of furniture or kitchen appliance provided with such a plate, e.g. a table, refrigerator, washing machine, spin drier, etc. The latter function is also fulfilled by the frequently encountered measure of extending the edge protection over and beyond the underside of the plate, so that it is readily possible to engage below the latter. In the case of kitchen equipment where the cover plate mainly serves for storing, setting down and working surface, the aim of the downwardly drawn edge protection is to cover the gap between the plate and the equipment casing. In this case on the underside of the plate there are frequently functional parts such as sleeves, clips, etc. made from a plastic material and fitted by injection moulding, so that the plate is fixed to the equipment casing. These functional parts are also covered by the edge protection.

The edge protection is made from a plastic material which is mechanically sufficiently stable and which is resistant to aggressive media and against weathering. This plastic material in an injection mould, in which is inserted the prefabricated core plate with a cover layer on one or two sides, is moulded onto the open-pore cut edges of the core plate, so that the plastic material penetrates the pores and the edge protection is locked to the core plate. At the same time the edge protection engages over at least the top of the core plate. This gives a firm and at the same time tight connection between the edge protection and the core plate. It is also known to manufacture the edge protection in a separate operation, e.g. by the injection moulding or extrusion of a ledge-like section and it is then connected to the core plate by bonding in a further operation.

The known injection moulding of the edge protection onto the core plate has the advantage that the sought after functions described above can be inexpensively achieved. However, it is disadvantageous that the edge protection cannot be subsequently removed. This problem occurs for environmental protection reasons if the table or cover plate, optionally also the furniture on which they are located, is subject to damage or rendered valueless or unusable in some other way and has to be supplied to waste utilization or there is a manufacturer return obligation, such as e.g. exists for refrigerators, who is then responsible for disposal and optionally reutilization. Then it is in particular necessary to separate on the basis of the individual materials, so that it is desirable in the case of cover or table plates to be able to completely or at least largely separate the edge protection with a relatively high plastics proportion which is reusable from the core plate.

This is made possible in the known construction according to the preamble of claim 1 (EP 555 738 A1) in that the edge protection comprises two angle sections injection moulded in a closed frame form, whereof an outer frame with a long leg covers the cut surfaces of the core plate and projects over the underside thereof and with the other leg engages over the top side, whereas the other, inner frame engages with its one leg on the inside of the long leg of the outer frame in its area projecting over the underside and with its other leg engages on the underside of the core plate and following the insertion of the core plate in the outer frame, both frames are interconnected by their engaging legs.

The two closed frames formed from angle sections can be manufactured in simple manner by injection moulding and consequently have an adequate dimensional stability. The prefabricated core plate can then be inserted from above in the outer frame located on its short leg, so that it rests with its top surface on the inside of the leg of the angle section, whereas the other, longer leg projects upwards.

Subsequently the inner frame and with a roughly parallel arrangement with the outer frame is fitted from above on the underside of the core plate until its one leg rests on the underside of the core plate. By joining the engaging legs a closed, frame-like structure is obtained, which completely surrounds the core plate, whose optionally open-pore areas of the cut cover and engage over the top and bottom of the edges of the core plate, so that the areas of the cut are effectively protected against the access of dirt and moisture. This gives the same functionally correct construction as with an injection moulded on edge protection. However, it is still possible to remove the edge protection with limited force from the core plate and to obtain the two components in type-pure manner, because there is no integral joint or, in the case of an injection moulded on edge protection, an intimate joint between the edge protection and the core plate.

However, the known plate or board suffers from certain disadvantages if in the form of a cover plate for domestic machines and equipments it is exposed to heat action in addition to the action of moisture. There can in particular be a cambering of the plate, as well as damage to the edge protection. This more particularly applies to the cover plates used for washing and rinsing machines, driers, etc.

The object of the present invention is to further develop the aforementioned, known plate, that it can withstand without damage thermal stresses, while providing an adequate moisture protection.

SUMMARY OF THE INVENTION

According to the invention this problem is solved in that between the inner frame and at least two adjacent surfaces of the cut of the core plate a gap is provided and that at least between the leg of the outer frame engaging over the top of the core plate and the top of said core plate an elastic seal is provided.

In the construction according to the invention between the frame forming the edge protection and the lateral faces of the core plate a gap is provided, which serves as an expansion gap. During expansion as a result of sudden temperature changes, the gap gives the plate an adequate clearance for expansion movements in the plate plane. Thus, the plate is not firmly locked by the edge protection and can consequently not undergo cambering. The edge protection is also not stressed by the expansion movements of the plate, so that there can be neither damage to the plate, nor to the edge protection. The seal, which is at least provided between the leg of the outer frame engaging over the top of the core plate and the core plate itself, prevents any access of moisture, which mainly collects on the top of the core plate forming the working surface.

Preferably a seal is also provided between the leg of the inner frame engaging over the underside of the core plate and the underside, so that access of moisture to the surfaces of cut of the core plate is effectively prevented.

The domestic machines involved here, such as rinsing or washing machines or driers have a thermally insulated casing or housing. The invention offers the possibility to wholly or completely do away with the casing insulation in the upper area and instead of this to provide the cover plate below the core plate with a corresponding insulating plate, which assumes responsibility for the thermal insulation in the upwards direction. This plate-like insulation can e.g. be bonded to the core plate.

In a preferred construction the leg of the outer or inner frame has on the side facing the core plate an all-round depression for receiving the seal.

This construction makes it possible for the elastic seal to only project slightly over the corresponding surface of the leg in order to obtain an adequate sealing action, but at the same time the leg engages so firmly on the core plate that dust, dirt and the like cannot penetrate between the leg and the core plate.

The seal can either be injection moulded into the depression or bonded in as a strip-like seal.

According to another embodiment the inner frame has a leg extending over the entire height of the surface of the cut of the core plate and engages on the underside of the leg of the outer frame engaging over the top of the core plate and which is adjacent to the gap on its one side.

This leads to an extremely stable edge protection, which also leaves the necessary expansion gap between it and the core plate.

The construction can also be such that the leg of the inner frame extending over the surface of the cut of the core plate can extend up to the lower edge of the longer leg of the outer frame and be connected therewith by means of the further leg.

The two angle sections forming the edge protection are joined in the present embodiment to form a closed frame with an externally smooth surface.

The gap between the core plate and the inner frame can be adapted to the particular needs. It is recommended that the minimum gap width is at least 0.5 mm on all sides. This gap naturally makes it possible to compensate manufacturing tolerances between the edge protection and the core plate.

BRIEF DESCRIPTION OF THE DRAWINGS

The invention is described in greater detail hereinafter relative to embodiments shown in FIGS. 1 to 5 of the drawings representing a section through the edge protection and through the broken away core plate.

DETAILED DESCRIPTION OF EMBODIMENTS

Figure 1:
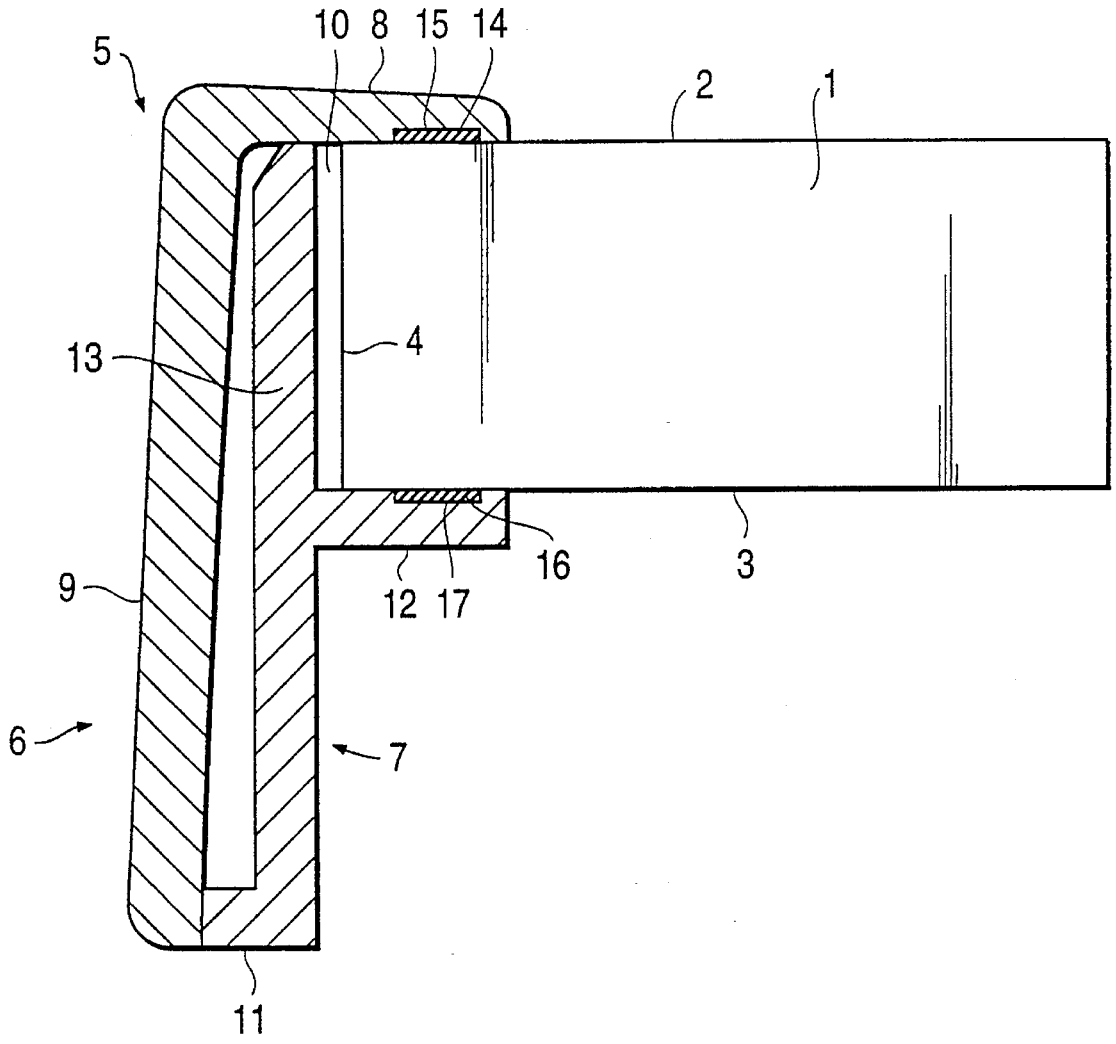

The cover table plate or board has in all the embodiments a wood material core plate 1, which at least on its top 2 and optionally on its underside 3 has a moisture proof cover layer, while the surfaces of cut 4 are open and generally have a porous surface. However, the core plate can also be made from glass, plastic or metal, e.g. aluminium. The plate also has an edge protection 5, which covers the surfaces of cut 4 and simultaneously engages over the top 2 and underside 3 of the core plate 1. If the plate is made from a wood material, in addition to the protective function access of moisture to the surface of cut is prevented.

In all the embodiments the edge protection comprises an outer frame 6 and an inner frame 7, in both cases constituted by an angle section. Both frames are separately manufactured by injection moulding. The outer frame 6 has a short leg 8 and a long leg 9. By means of the leg 8 the outer frame 6 engages over the top 2 of the core plate 1, whereas the longer leg 9 projects downwards over the underside 3 of the core plate 1. The inner frame 7 has a short leg 12 engaging on the underside 3 of the core plate 1 and a further leg 11 with which it is connected to the longer leg 9 of the outer frame 6, e.g. by welding, bonding, etc. Finally the inner frame 7 has a leg 13, which extends over the height of the surface of cut 4 of the core plate 1.

Between the leg 13 and the surface of cut 4 of the core plate is provided a gap 10, which serves as an expansion gap for the core plate 1. This gap should be present on at least two adjacent surfaces of cut of the core plate 1, but can optionally pass all round the same.

Between the short leg 8 of the outer frame 6 and the top 2 of the core plate 1 is provided an elastic seal 14, which is preferably injection moulded, poured or bonded into a depression 15 on the leg 8. In the embodiment according to FIG. 1 there is a further seal 16 between the leg 12 of the inner frame 7 and the underside of the core plate 1 and is once again preferably inserted in a depression 17 on the leg 12. These seals prevent the access of moisture to the surface of cut 4 of the core plate 1.

Figure 2:
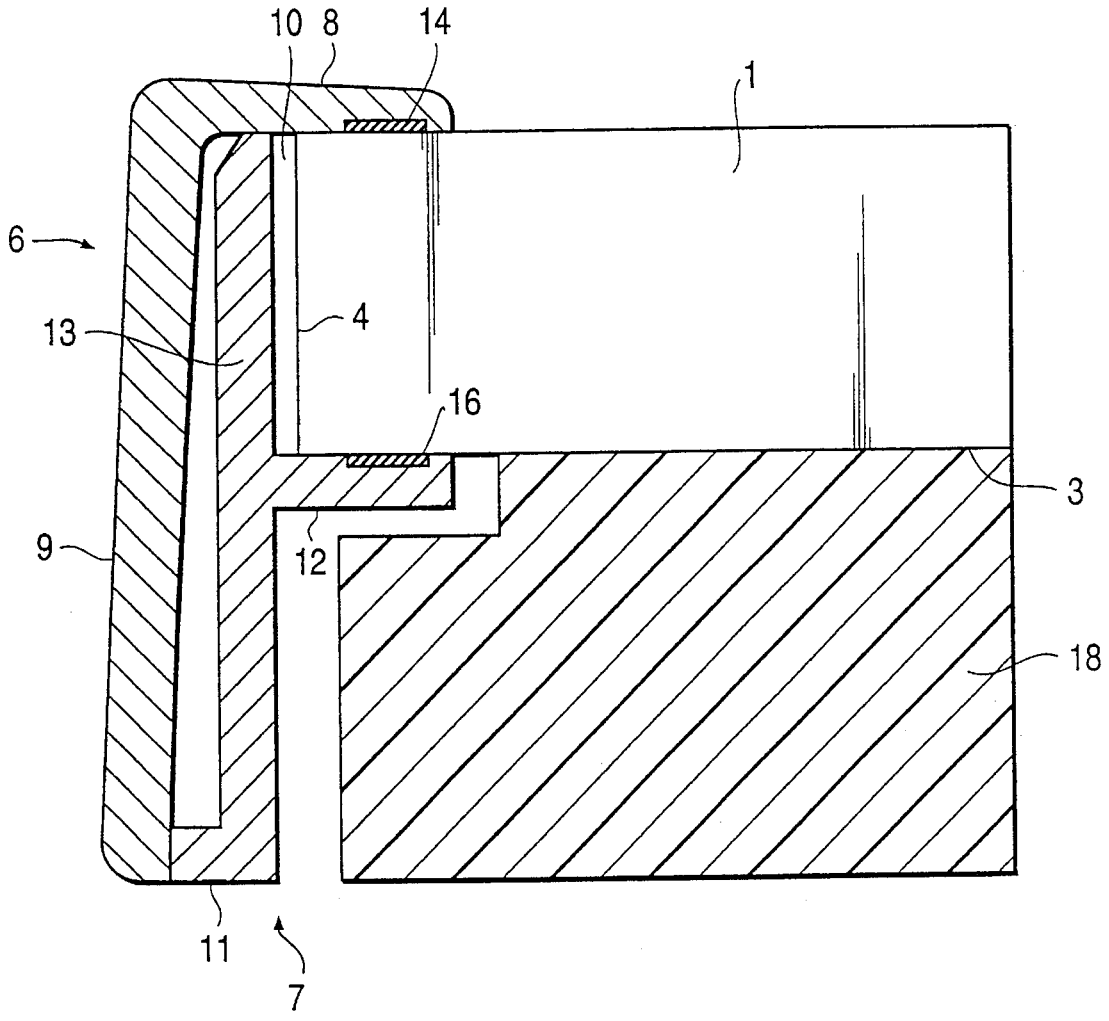

The embodiment of FIG. 2 differs from that of FIG. 1 only in that on the underside 3 of the core plate 1 is provided an insulating plate 18, which forms a thermal insulation between the domestic machine to be covered and the core plate.

Figure 3:
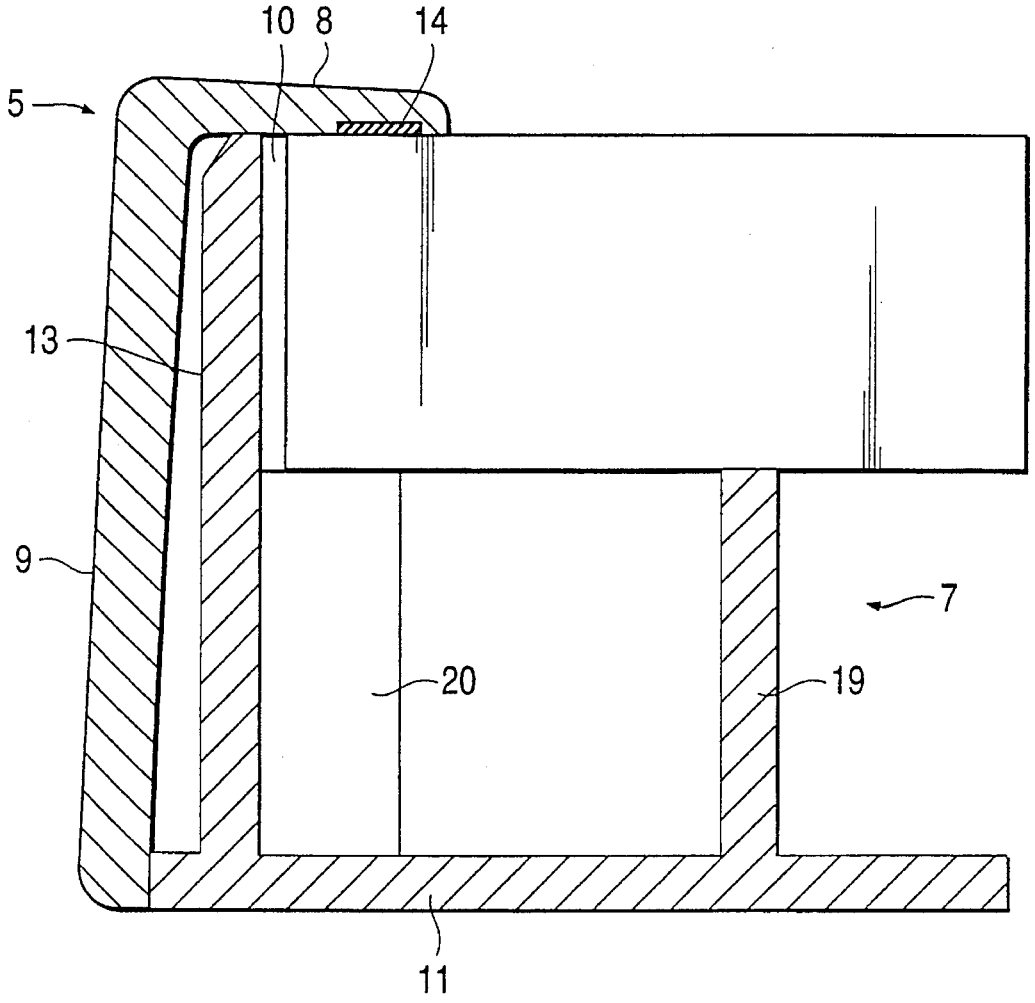
Figure 4:
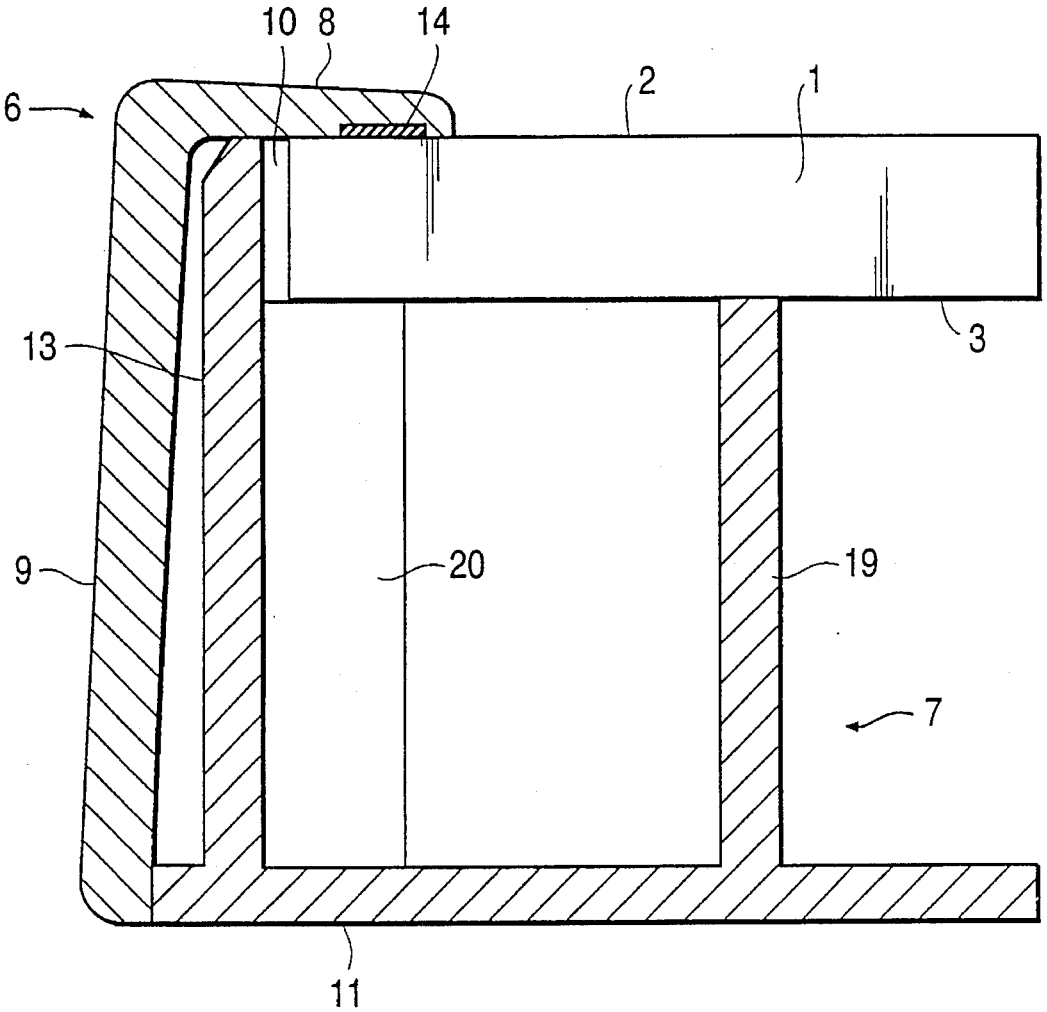

In the embodiment according to FIG. 3 the inner frame 7 simultaneously forms a further functional part, in which the lower leg 11 extends below the core plate and is supported by means of ribs 19, 20 on the underside of the core plate. The frame parts 11, 19 and 20 here simultaneously serve as aids for the fastening of the cover plate to the domestic machine. FIG. 4 shows a similar construction with a thinner core plate and higher ribs 19, 20.

Figure 5:
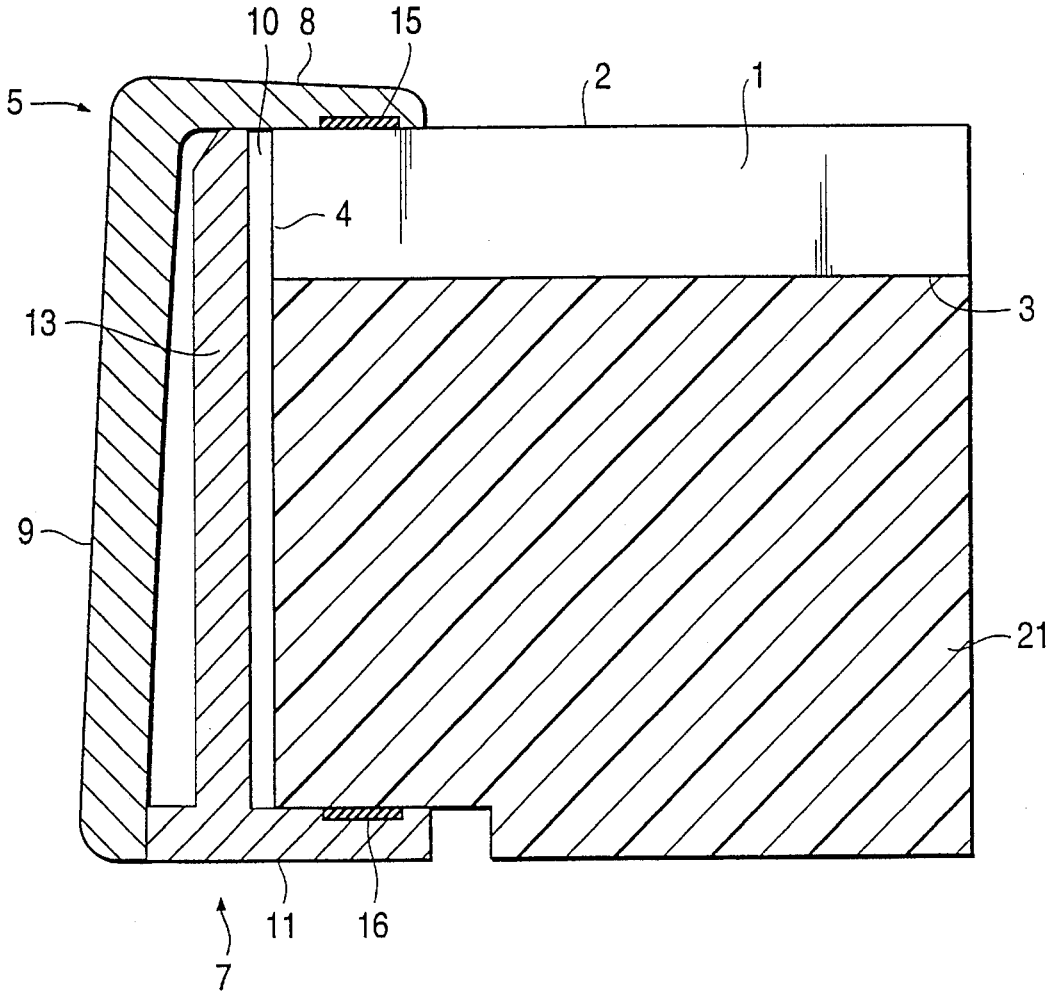

In the embodiment according to FIG. 5 the plate over which the edge protection engages comprises the core plate 1 and a further insert plate 21, which can e.g. once again be made from an insulating material. In this case the lower leg 11 of the inner frame engages over the insert plate 21 in a corresponding depression on the underside and has the seal 16 at this point.

We claim:

1. An assembly comprising at least one core plate having a top, an underside and a cut lateral surface and peripheral plastic edge protection contacting the top and the underside of the core plate and which comprises two moulded angle sections including inner and outer frames, the outer frame having a first leg contacting the underside and a second leg contacting the top, the inner frame having a first leg inside of the first leg of the outer frame in an area projecting over the underside and a second leg contacting the underside of the core plate and after insertion of the at least one core plate in the outer frame and mounting of the inner frame on the core plate, the inner and outer frames are connected together at their first legs and between the inner frame and the cut lateral surface of the core plate is disposed a gap and at least between the second leg of the outer frame and the top is disposed an elastic seal.

2. An assembly according to claim 1 wherein:

the inner frame has a leg facing an entire height of the cut lateral surface which contacts an underside of the second leg of the outer frame and which bounds the gap.

3. An assembly according to claim 2 wherein:

the leg of the inner frame facing the entire height of the cut lateral surface extends to a lower edge of the first leg of the outer frame and is connected thereto by means of an additional leg.

4. An assembly according to claim 3 wherein:

the gap between the inner frame and the cut lateral surface is at least 0.5 mm.

5. An assembly according to claim 2 wherein:

the gap between the inner frame and the cut lateral surface is at least 0.5 mm.

6. An assembly according to claim 1 wherein:

the gap between the inner frame and the cut lateral surface is at least 0.5 mm.

7. An assembly according to claim 1 wherein:

between the second leg of the inner frame and the underside of the core plate is disposed a seal.

8. An assembly according to claim 7 wherein:

one of the second legs on a side facing the core plate is disposed a peripheral depression for receiving the seal.

9. An assembly according to claim 8 wherein:

the inner frame has a leg facing an entire height of the cut lateral surface which contacts an underside of the second leg of the outer frame and which bounds the gap.

10. An assembly according to claim 9 wherein:

the leg of the inner frame facing the entire height of the cut lateral surface extends to a lower edge of the first leg of the outer frame and is connected thereto by means of an additional leg.

11. An assembly according to claim 8 wherein:

the gap between the inner frame and the cut lateral surface is at least 0.5 mm.

12. An assembly according to claim 8 wherein:

the seal is injection moulded into the peripheral depression.

13. An assembly according to claim 12 wherein:

the inner frame has a leg facing an entire height of the cut lateral surface which contacts an underside of the second leg of the outer frame and which bounds the gap.

14. An assembly according to claim 13 wherein:

the leg of the inner frame facing the entire height of the cut lateral surface extends to a lower edge of the first leg of the outer frame and is connected thereto by means of an additional leg.

15. An assembly according to claim 12 wherein:

the gap between the inner frame and the cut lateral surface is at least 0.5 mm.

16. An assembly according to claim 8 wherein:

the seal is bonded into the depression.

17. An assembly according to claim 16 wherein:

the inner frame has a leg facing an entire height of the cut lateral surface which contacts an underside of the second leg of the outer frame and which bounds the gap.

18. An assembly according to claim 17 wherein:

the leg of the inner frame facing the entire height of the cut lateral surface extends to a lower edge of the first leg of the outer frame and is connected thereto by means of an additional leg.

19. An assembly according to claim 16 wherein:

the gap between the inner frame and the cut lateral surface is at least 0.5 mm.

20. An assembly according to claim 7 wherein:

the inner frame has a leg facing an entire height of the cut lateral surface which contacts an underside of the second leg of the outer frame and which bounds the gap.

21. An assembly according to claim 20 wherein:

the leg of the inner frame facing the entire height of the cut lateral surface extends to a lower edge of the first leg of the outer frame and is connected thereto by means of an additional leg.

22. An assembly according to claim 7 wherein:

the gap between the inner frame and the cut lateral surface is at least 0.5 mm.

* * * * *